United States Patent [19]

Kohler

[11] 4,159,476

[45] Jun. 26, 1979

[54] EJECTION FUZE

[75] Inventor: Hans W. Kohler, Washington, D.C.

[73] Assignee: The United States of America as represented by the Secretary of the Army, Washington, D.C.

[21] Appl. No.: 451,077

[22] Filed: Aug. 19, 1954

[51] Int. Cl.[2] ..... F42C 13/04

[52] U.S. Cl. ..... 343/7 PF; 102/214; 328/147

[58] Field of Search ..... 343/7, 11, 13, 5, 7 PF; 102/70.2 P, 214, 70.2; 250/27 T, 27 PS; 328/147, 156, 158

[56] References Cited

U.S. PATENT DOCUMENTS 4,021,803 5/1977 Richmond et al. ..... 343/7 PF

*Primary Examiner*—Tubbesing

*Attorney, Agent, or Firm*—Nathan Edelberg; Robert P. Gibson; Saul Elbaum

EXEMPLARY CLAIM

1. An ordnance fuze adapted to function at a predetermined time interval in advance of predicted missile-target intercept, said fuze comprising: means for sensing missile-to-target distance; means for initiating the generation of a first waveform voltage when the missile reaches a first predetermined distance from the target; means for initiating the generation of a second waveform voltage when the missile reaches a second and shorter predetermined distance from the target; comparator means for comparing two voltages and producing a comparator output signal when the two voltages being compared become equal; a source of constant direct-current offset voltage interposed between one of said first and second waveform voltages and said comparator means; means for applying the other of said first and second waveform voltages to said comparator means; and means for utilizing said output signal from said comparator means to function the fuze.

8 Claims, 6 Drawing Figures

Fig. 5.
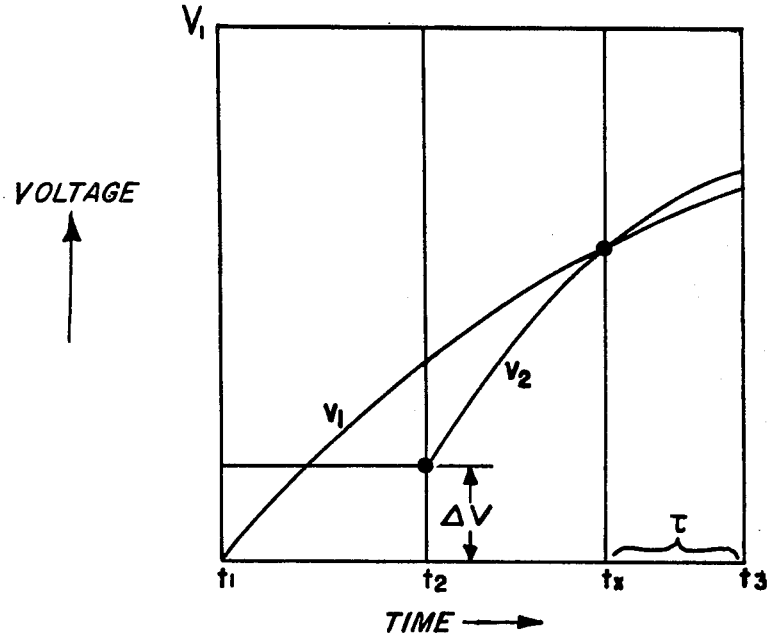
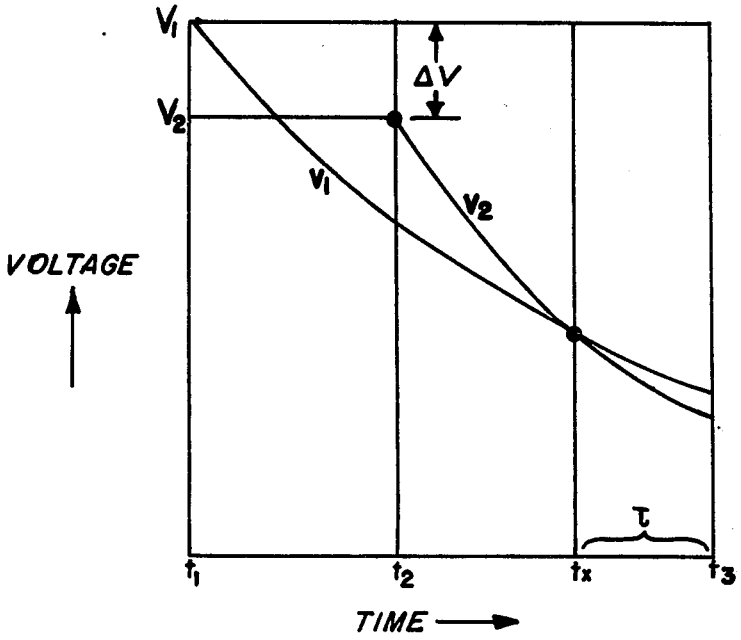
Fig. 6.

EJECTION FUZE

The invention described herein may be manufactured and used by or for the Government for governmental purposes without the payment to me of any royalty thereon.

This invention relates to fuzes for ordnance projectiles and more particularly to fuzes for causing small projectiles to be ejected from the main projectile. In a principle embodiment of of the present invention, a ring of bomblets around the circumference of a guided missile are ejected from the missile as the missile approaches a target; regardless of the speeds of the projectile and the target, the invention causes the bomblets to be ejected at a fixed time interval in advance of missile-target intercept, so that the bomblet cluster in every case attains a predetermined optimum diameter by the time of intercept.

Recent studies have shown that cluster warheads of the type indicated above may have certain advantages over fragmentation warheads of the same weight. The bomblets that make up the cluster are fuzed individually to cause burst at very close proximity to, or on contact with, the target. The present invention, in its preferred embodiments, relates only to the fuze for ejecting the cluster from the missile.

In a cluster warhead of typical design the bomblets are ejected at right angles to the axis of the missile. In general, the velocity of ejection is considerably less than the velocity of the missile. Besides having this component of motion at right angles to the missile, the bomblets have a forward component of motion that is practically equal to the missile velocity at all times of interest. In other words, after the bomblets are ejected they move forward as a circular cluster of increasing diameter. The time required after ejection for the bomblet cluster to reach optimum diameter is independent of the velocity of the missile and/or the target. For example, in one guided missile warhead—the ejection velocity being constant—the cluster reaches optimum diameter in ¼ second.

In a preferred embodiment of my invention, a radar pulse reflected from the target actuates a first coincidence circuit when the missile is a certain predetermined distance from the target—2500 feet, for example. The signal from this first coincidence circuit starts a first waveform generator. At a second predetermined distance—1500 feet, for example—a second waveform generator is similarly started. These two generators are so designed that their outputs, which are compared by a voltage comparator circuit, become equal at missile-target intercept. By adding a fixed offset voltage to the output of one of the generators, signal equality, as sensed by the voltage comparator, is made to occur at a desired fixed time interval before intercept. When the voltages at the comparator become equal, the comparator gives an output pulse that initiates ejection. By adjustment of the offset voltage, any desired cluster diameter at intercept can be obtained.

A principal object of the present invention is to provide a fuze for so timing the ejection of bomblets from a cluster warhead that the bomblet cluster will be of optimum diameter upon intercept with the target, regardless of the relative and absolute velocities of missile and target.

Other objects, aspects, uses, and advantages of the invention will become apparent from the accompanying drawing and from the following description.

FIG. 5 is a corresponding voltage-time diagram for rising exponential waves.

FIG. 6 is a corresponding voltage-time diagram for falling exponential waves.

Figure 1:
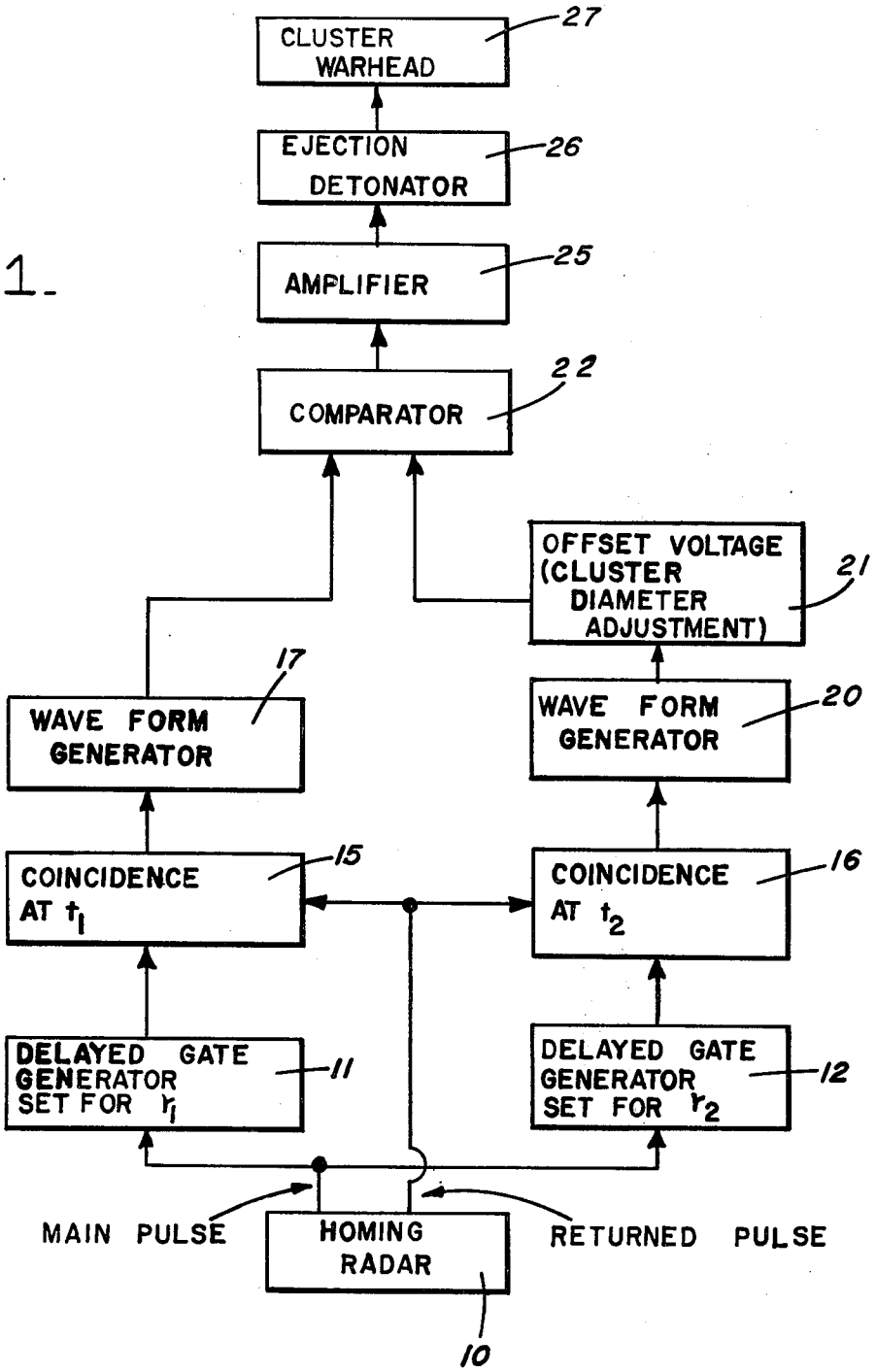
FIG. 1 is a block diagram of a preferred embodiment of the invention.

In FIG. 1, homing radar 10 is a radar set carried by the guided missile on which the fuze is used. Delayed gate generators 11 and 12 are triggered synchronously with the main pulse transmitted by radar 10. Generator 11 applies a gating pulse to coincidence circuit 15 at a predetermined time interval after the transmission of each main pulse. Generator 12 similarly applies a gating pulse to coincidence circuit 16 at a shorter predetermined time after each main pulse. The radar pulse returned from the target is also applied to coincidence circuits 15 and 16. Generator 11 is set so that its gating pulse corresponds to a missile-to-target range of $r_1$—2500 feet, for example—and generator 12 is set so that its gating corresponds to a shorter missile-to-target range $r_2$—1500 feet, for example. It will be readily understood by those familiar with the radar art that, with this arrangement, coincidence circuit 15 will produce an output pulse when the missile is at range $r_1$, and that coincidence circuit 16 will thereafter produce another output pulse when the missile is at range $r_2$.

At range $r_1$ the output pulse from coincidence circuit 15 initiates the generation of a voltage by wave-form generator 17. Similarly, at range $r_2$ the output pulse of coincidence circuit 16 initiates the generation of another voltage by wave-form generator 20. These two voltages are preferably of rising or falling exponential waveform, although rising or falling sawtooth waves may also be used. As will be explained more fully below, generators 17 and 20 can be made to produce waveforms such that the two voltages will become equal at the time of predicted missile-target intercept. The output of the two generators is compared by voltage comparator 22, except that a fixed d-c offset voltage 21 may be interposed between generator 20 and comparator 22. With suitable generator waveforms, as will be shown more fully below, the voltages compared by comparator 22 will become equal at a fixed time interval before predicted missile-target intercept, this time interval being independent of relative missile-target velocity.

When the voltages at comparator 22 become equal, comparator 22 produces an output signal that is amplified by amplifier 25 and applied to ejection detonator 26 to cause ejection of bomblets from cluster warhead 27. Because the bomblets are ejected at a fixed time interval before missile-target intercept, the bomblet cluster attains a predetermined diameter at the time of missile-target intercept, in accordance with the principal object of the invention. The time interval between cluster release and target intercept, and thus the cluster diameter at intercept, is determined by the characteristics of generators 17 and 20 and/or by offset voltage 21.

Since the operativeness of the invention depends upon the characteristics of wave form generators 17 and 20, the requirements for these generators 17 and 20 will now be more fully considered. It will be shown that several well known wave forms, including exponential wave forms produced by simple resistance-capacitance generators, have the required characteristics if the proper constants are selected.

Figure 2:
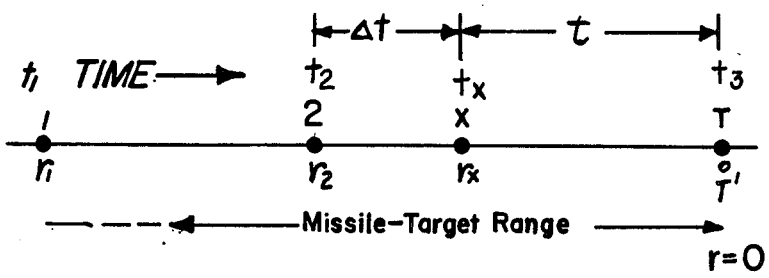
FIG. 2 is a diagram of the course of a missile from position 1 at time $t_1$ and range $r_1$ until it reaches a target T at range 0 and time $t_3$. T' is a target slightly displaced from its predicted position.

FIG. 2 shows the path of a missile along the straight-line relative trajectory $\overline{12XT}$, with the target at T. Distances $\overline{1T}$ equals $r_1$ and $\overline{2T}$ equals $r_2$ are fixed missile-target ranges, and $\overline{XT}$ equals $r_x$ is the variable release range required for a constant release-to-target time interval $\tau$. Release must take place at a variable time $\Delta t$ after the missile reaches range $r_2$.

In good approximation, the release time problem with which the present invention is concerned is one dimensional, assuming constant velocity vectors for missile, bomblets, and target, with point missile and point target on a collision course. The error in computed release time caused by finite instead of zero miss distance is very small, provided missile-target range is measured accurately. In FIG. 2 range $\overline{2T}$, for example, very nearly equals $\overline{2T'}$ since $\overline{2T} > 1000$ ft and $\overline{TT'} < 100$ ft.

Assuming the center of gravity of the cluster to move at the same constant speed as the missile along the relative trajectory, the release time, measured from the instant of the second range measurement, is $$\Delta t = \frac{r_2}{V_R} - \tau \quad (1)$$

$$V_R = \frac{r_1 - r_2}{t_2 - t_1} \quad (2)$$

$\tau$ is the bomblet transit time to cover the desired cluster radius. $V_R$ is the relative missile-target velocity.

From (1) and (2)

$$\Delta t + \tau = k(t_2 - t_1) \quad (3)$$

where $$k = \frac{r_2}{r_1 - r_2} = \text{constant} \quad (3)$$

The basic problem in finding $\Delta t$ thus is to generate a time interval $(\Delta t + \tau)$ proportional to a previously measured interval $(t_2 - t_1)$, and to subtract from it a fixed interval $\tau$.

Figure 3:
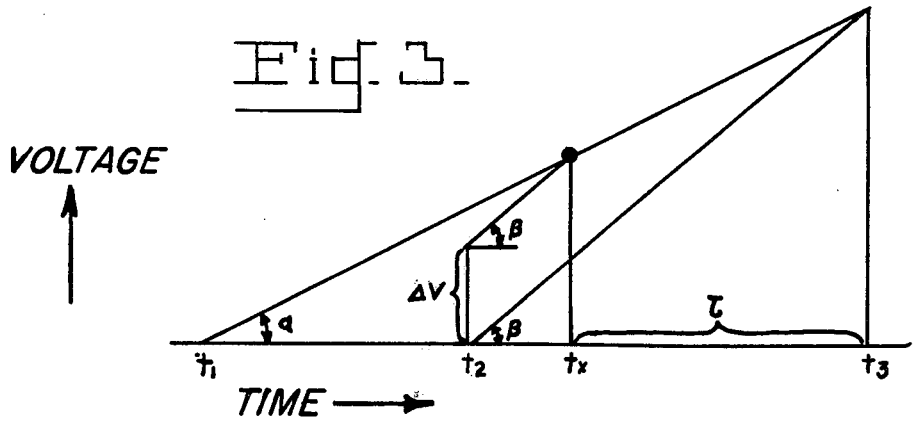
FIG. 3 is a voltage-time diagram showing how two rising sawtooth waves having rise angles $\alpha$ and $\beta$ and offset by a fixed voltage $\Delta V$ can be used for the computation required by the invention.

FIG. 3 is explanatory of an embodiment of the invention in which generator 17 is adapted to produce an output signal that at range $r_1$ (time $t_1$) begins to rise from zero and continues to increase at a constant rate of $A = \tan \alpha$ volts per second during all times of interest. Similarly, generator 20 is adapted to produce an output signal that at range $r_2$ (time $t_2$) begins to rise from zero and continues to rise at a constant and greater rate $B = \tan \beta$ volts per second during all times of interest. The ratio of rise rates A and B is inversely proportional to the preselected measurement ranges $r_1$ and $r_2$—i.e., $$\frac{A}{B} = \frac{\tan\alpha}{\tan\beta} = \frac{r_2}{r_1}$$

It will be understood that, with generators 17 and 20 designed to have these fixed rise rates A and B, the outputs of generators 17 and 20 will become equal at the range $r = 0$ (predicted missile-target intercept) regardless of missile-target approach velocity.

Now if cluster diameter adjustment 21 is adjusted to introduce a fixed offset voltage $\Delta V$ (of the same polarity as the outputs of generators 17 and 20) between generator 20 and comparator 22, it will be understood upon consideration of FIG. 3 that the voltage reaching comparator 22 from generator 20 will become equal to that reaching comparator 22 from generator 17 a fixed time $\tau$ seconds sooner than if there were no offset voltage. Consideration of the geometry of FIG. 3 will show that $$\tau = \frac{\Delta V}{\tan\beta - \tan\alpha} = \frac{\Delta V}{B - A}.$$

$\tau$ is thus independent of missile-target approach velocity.

Figure 4:
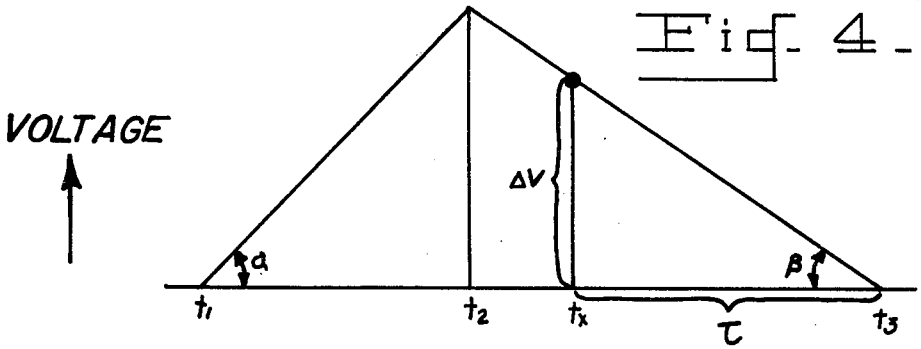
FIG. 4 is a voltage-time diagram showing the similar use of rising and falling sawtooth waves for computation.

FIG. 4 is explanatory of an embodiment of the invention in which generator 17 is adapted to produce an output signal that at range $r_1$ (time $t_1$) begins to rise from zero and continues to increase at a constant rate of $A = \tan \alpha$ volts per second until the missile reaches the range $r_2$ (time $t_2$), at which time the voltage applied to comparator 22 from generator 17 has attained the value $A(t_2 - t_1)$ volts. At range $r_2$ generator 20 starts to reduce, at a constant rate $B = \tan \beta$ volts per second, the voltage $A(t_2 - t_1)$ that has been developed at comparator 22 by generator 17. Comparator 22 senses when the voltage $A(t_2 - t_1) - B(t - t_2)$ becomes equal to a predetermined fixed value $\Delta V$ established by cluster diameter adjustment 21. Slopes A and B of generators 17 and 20 are fixed and their ratio is made proportional to $$\frac{r_2}{r_1 - r_2};$$

i.e., $$\frac{A}{B} = \frac{\tan \alpha}{\tan \beta} = \frac{r_2}{r_1 - r_2}.$$

If $\Delta V$ is made zero, the reduction of voltage at comparator 22 to $\Delta V$ (zero) occurs at the range $r = 0$ (predicted missile-target intercept). From the geometry of FIG. 4 it can be seen that, for a positive value of $\Delta V$, the voltage at comparator 22 is reduced to $\Delta V$ at a fixed time interval $$\tau = \frac{\Delta V}{\tan \beta} = \frac{\Delta V}{B}$$

seconds sooner than if there were no offset voltage.

FIGS. 5 and 6 are explanatory of embodiments of the invention in which generators 17 and 20 have exponential waveforms, such as the waveforms characteristic of the charging or discharging of a capacitance through a resistance.

FIG. 5 is explanatory of an embodiment of the invention in which generator 17 is adapted to produce an output signal $V_1$ that at the range $r_1$ (time $t_1$) begins to rise from zero toward an asymptote $V_1$ in accordance with a first exponential voltage-time relation. Similarly, generator 20 is adapted to produce an output signal $v_2$ that at range $r_2$ (time $t_2$) begins to rise from an initial value $\Delta V$ toward the same asymptote $V_1$ in accordance with a second and steeper exponential voltage-time relation. As will be understood in the light of the explanation that follows in connection with FIG. 6, the characteristics of these two exponential voltage-time relations are such that the $v_2$ signal attains equality with the $v_1$ signal at a fixed predetermined time $\tau$ in advance of predicted missile-target intercept, $\tau$ being independent of missile-target approach velocity. Since in this embodiment the necessary offset voltage $\Delta V$ is incorporated in generator 20, offset voltage 21 may be set to zero.

FIG. 6 is explanatory of an embodiment of the invention in which generator 17 is adapted to produce an output signal $v_1$ that at range $r_1$ (time $t_1$) begins to decrease from an initial value $V_1$ asymptotically toward zero, in accordance with a first exponential relation $v_1=V_1e^{-k1(t-t1)}$. Generator 20 is adapted to produce an output signal $v_2$ that at range $r_2$ (time $t_2$) begins to decrease from the initial value $V_2=V_1-\Delta V$ asymptotically toward zero in accordance with a second and steeper exponential relation $v_2=(V_1-\Delta V)e^{-k2(t-t2)}$. It will be understood that $K_1$ and $k_2$ are the reciprocals of the time constants of generators 17 and 20 respectively. As will be shown below, if these time constants are chosen so that $k_1/k_2=r_2/r_1$, the $v_2$ signal from generator 20 will become equal to the $v_1$ signal from generator 17 at a fixed predetermined time $\tau$ in advance of predicted missile-target intercept, $\tau$ being independent of missile-target approach velocity. As in the case of the embodiment to which FIG. 5 relates, the necessary offset voltage $\Delta V$ is incorporated in generator 20 and offset voltage 21 (FIG. 1) may be set to zero.

The operativeness of the embodiments to which FIGS. 5 and 6 relate will be understood in the light of the following derivation, which relate particularly to FIG. 6.

$$v_1=V_1e^{-k1(t-t1)}\ t\leqq t_1 \tag{4}$$

$$v_2=(V_1-\Delta V)e^{-k2(t-t2)}\ t\leqq t_2 \tag{5}$$

$$\text{Let } (V_1-\Delta V)=V_1e \tag{6}$$

where b is a constant.

Substituting (6) into (5) and letting $v_1=v_2$ for which $t=t_x$, $$k_1(t_x-t_1)=k_2(t_x-t_2)+b \tag{7}$$

$t_x$=cluster release time

For b=0 in (7)

$$t_x=t_3$$
$$k_1(t_3-t_1)=k_2(t_3-t_2) \tag{8}$$

Subtracting (7) from (8), $$k_1(t_3-t_x)=k_2(t_3-t_x)-b\ t_3-t_x=\tau=b/k_2-k_1 \tag{9}$$

From (6)

$$b=\log_e\left(\frac{V_1}{V_1-\Delta V}\right)$$

Combining (9) and (10)

$$\tau=\frac{\log_e\left(\frac{V_1}{V_1-\Delta V}\right)}{k_2-k_1} \tag{11}$$

From (8)

$$k_1r_1=k_2r_2 \tag{12}$$

$1/k_1$ and $1/k_2$ are the RC time constants of the first and second exponential, respectively.

In the light of the foregoing analysis, persons skilled in the electronic art will be enabled to construct waveform generators of well known types having constants that will give them the characteristics needed for use as generators 17 and 20 of the invention.

The advantage of the exponential over the linear method of computation is that it uses somewhat simpler circuitry and fewer tubes. In some applications a disadvantage of the exponential method is that the rate of change of the two voltage waves decreases exponentially with time. If a wide range of relative velocities must be handled by the computer, the major part of the voltage available for the exponentials must be used, leading to small-angle intersection of the two curves for the low velocity cases, and making accurate determination of the release time more difficult.

It is of interest to mention the possibilities of prediction by digital computation. FIGS. 3 and 4 are applicable to this case if the ordinates represent counter readings.

In FIG. 3 two binary counters are involved, being stepped at rates proportional to $\tan\alpha$ and $\tan\beta$, respectively. The second counter does not start from 0 but is offset by a desired amount corresponding to $\Delta V$. Release time $t_x$ occurs upon equality of the counter readings.

FIG. 4 can be visualized in terms of a single reversible counter. At $t_2$ the counter is reversed and its stepping rate changed in accord with angles $\alpha$ and $\beta$.

A simplification occurs if $r_1=2r_2$ which permits the stepping rate of counter 2 to be twice that of counter 1 (FIG. 3).

In FIG. 4 the condition $r_1=2r_2$ leads obviously to the same stepping rate before and after reversal. One advantage of the digital computation method is its ability to discern equality (or inequality) accurately. No matter what the stepping rates are, there is no "sliding cut effect" and no requirements for high stability of power supply voltage. Stepping rates for the counters of the order of 1 kc provide sufficient time resolution in this application. The total counting time will generally not exceed 3 seconds. Thus, for the scheme of FIG. 3 two 11-stage binary counters are probably sufficient. Using transistors, this computer can be built in a small space using little power.

It will be apparent that the embodiments shown are only exemplary and that various modifications can be made in construction and arrangement within the scope of the invention as defined in the appended claims.

I claim:

1. An ordnance fuze adapted to function at a predetermined time interval in advance of predicted missile-target intercept, said fuze comprising: means for sensing missile-to-target distance; means for initiating the generation of a first waveform voltage when the missile reaches a first predetermined distance from the target; means for initiating the generation of a second waveform voltage when the missile reaches a second and shorter predetermined distance from the target; comparator means for comparing two voltages and producing a comparator output signal when the two voltages being compared become equal; a source of constant direct-current offset voltage interposed between one of said first and second waveform voltages and said comparator means; means for applying the other of said first and second waveform voltages to said comparator means; and means for utilizing said output signal from said comparator means to function the fuze.

2. An ordnance fuze adapted to function at a predetermined time interval in advance of missile-target intercept, said fuze comprising: radar means for periodically transmitting a main pulse and for receiving, after a time interval proportional to missile-target distance, a returned pulse reflected from the target; first and second coincidence circuits; means for applying said returned pulse to said coincidence circuits; first and second delayed gate generators adapted to apply gating pulses to said first and second coincidence circuits respectively at predetermined time intervals after said main pulse, so that said first coincidence circuit produces a first output pulse when the missile reaches a first predetermined distance from the target and so that said second coincidence circuit produces a second output pulse when the missile reaches a second and shorter predetermined distance from the target; a first waveform generator adapted to initiate the generation of a first exponential waveform voltage upon receiving said first output pulse; a second waveform generator adapted to initiate the generation of a second exponential waveform voltage upon receiving said second output pulse; voltage comparator means for comparing two voltages and producing a comparator output signal when the two voltages being compared become equal; a source of constant direct-current offset voltage interposed between one of said first and second exponential waveform voltages and said voltage comparator means; means for applying the other of said first and second waveform voltages to said comparator means; and utilization means adapted to function upon receiving said comparator output signal.

3. The invention according to claim 2, the functioning of said utilization means causing the ejection of bomblets from the missile.

4. An ordnance fuze adapted to function at a predetermined time interval in advance of missile-target intercept, said fuze comprising: radar means for periodically transmitting a main pulse and for receiving, after a time interval proportional to missile-target distance, a returned pulse reflected from a target; first and second coincidence circuits; means for applying said returned pulse to said coincidence circuits; first and second delayed gate generators adapted to apply gating pulses to said first and second coincidence circuits respectively at predetermined time intervals after said main pulse, so that the first coincidence circuit produces a first output pulse when the missile at a time $t_1$ reaches a first predetermined distance $r_1$ from the target and so that the second coincidence circuit produces a second output pulse when the missile at a later time $t_2$ reaches a second and shorter predetermined distance $r_2$ from the target; generator means triggered by said first and second pulses respectively for generating first and second signals having first and second unidirectionally changing waveforms respectively, said waveforms being of generally similar types; fixed offset voltage means for giving said second signal an initial bias $\Delta V$ in the direction of equality with said first signal; and a firing circuit actuated by the attainment by said second signal of equality with said first signal; said waveforms being such that such equality is attained at the time $$t_x = t_2 + \frac{r_2(t_2 - t_1)}{r_1 - r_2} - \tau,$$

$\tau$ being a constant dependent upon $\Delta V$ and independent of missile-target approach velocity.

5. The invention according to claim 6, wherein said generator means comprises: a first generator triggered by said first pulse for generating a first signal that at range $r_1$ and time $t_1$ begins to rise from zero and increases at a constant rate A; a second generator triggered by said second pulse for generating a second signal that at range $r_2$ and time $t_2$ begins to rise from zero at a constant and greater rate $B=r_1A/r_2$; and wherein said fixed offset voltage means adds to said second signal a constant increment $\Delta V$; said constant $\tau$ being equal to $\Delta V/B\text{-}A$.

6. The invention according to claim 6, wherein said generator means comprises: means triggered by said first pulse for generating a first signal that at range $r_1$ and time $t_1$ begins to rise from zero and increases at a constant rate A, attaining the value A $(t_2-t_1)$ at range $r_2$ and time $t_2$; means triggered by said second pulse for generating a second signal that at range $r_2$ and time $t_2$ begins to rise from zero at a constant rate $B=(r_1-r_2)A/r_2$; and wherein said fixed offset voltage means adds to said second signal a constant increment $\Delta V$; said firing circuit being actuated by the attainment by said second signal of the value A $(t_2-t_1)$ and said constant $\tau$ being equal to $\Delta V/B$.

7. The invention according to claim 6, wherein said generator means comprises: first means triggered by said first pulse for generating a first signal $v_1$ that at range $r_1$ and time $t_1$ begins to change from an initial value $E_1$ in the direction of an asymptote $E_2$ in accordance with a first exponential relation $$v_1=E_2-(E_2-E_1)e^{-k1(t-t1)};$$

second means triggered by said second pulse for generating a second signal $v_2$ that at range $r_2$ and time $t_2$ begins to change from an initial value $E_1+\Delta V$ in the direction of the asymptote $E_2$ in accordance with a second exponential relation $$v_2=E_2-(E_2-E_1-\Delta V)e^{-k2(t-t2)},$$

where $k_1$ = a positive constant equal to the reciprocal of the time constant of said first means, $k_2=r_1k_1/r_2$ = a positive constant equal to the reciprocal of the time constant of said second means, and $\Delta V$ = a fixed offset voltage having the same polarity as $E_2-E_1$;

said firing circuit being actuated by the attainment of equality of $v_2$ with $v_1$ and said constant $\tau$ being equal to $$\frac{\log_e\left(\frac{E_1}{E_1 - \Delta V}\right)}{k_2 - k_1}.$$

8. An electronic circuit adapted to receive a first pulse at a time $t_1$ and a second pulse at a later time $t_2$ and to generate an output signal at a still later time $t_x = t_2 + k(t_2 - t_1) - \tau$, where k is a positive constant and $\tau$ is a constant $< k(t_2 - t_1)$, said circuit comprising: generator means triggered by said first and second pulses respectively for generating first and second signals having first and second unidirectionally changing waveforms respectively, said waveforms being of generally similar types; fixed offset voltage means for giving said second signal an initial bias $\Delta V$; and means responsive to the attainment by said second signal of equality with said first signal; said waveforms being such that said constant is dependent upon said bias $\Delta V$ but independent of the time interval $t_2 - t_1$.

* * * * *